United States Patent [19]

Frajdenrajch

[11] Patent Number: 5,052,377

[45] Date of Patent: Oct. 1, 1991

[54] APPARATUS FOR MASSAGING THE BODY BY CYCLIC PRESSURE, AND CONSTITUENT MEANS

[76] Inventor: Jean Frajdenrajch, 28 rue Saint-Rome, 31000 Toulouse, France

[21] Appl. No.: 360,092

[22] Filed: Jun. 1, 1989

[51] Int. Cl.[5] ..... A61H 9/00

[52] U.S. Cl. ..... 128/64; 128/39; 128/24 R

[58] Field of Search ..... 128/33, 39, 64, 24 R, 128/DIG. 20

[56] References Cited

U.S. PATENT DOCUMENTS

| | | | |
|---|---|---|---|
| 3,167,067 | 1/1965 | Rand | 128/24 R |
| 4,311,135 | 1/1982 | Brueckner et al. | 128/24 R |

FOREIGN PATENT DOCUMENTS

| | | |
|---|---|---|
| 2753523 | 12/1977 | Fed. Rep. of Germany . |
| 2405708 | 10/1978 | France . |
| 2511241 | 8/1982 | France . |
| 483111 | 4/1938 | United Kingdom . |
| 2077108 | 6/1980 | United Kingdom . |
| 2062235 | 5/1981 | United Kingdom . |

*Primary Examiner*—Edgar S. Burr
*Assistant Examiner*—Lisa E. Malvaso
*Attorney, Agent, or Firm*—Harold H. Dutton, Jr.

[57] ABSTRACT

An apparatus for massaging parts of the body by sequential cyclic pressure for assuring a lymphatic drainage, the apparatus comprising means for cyclic distribution of an inflating fluid through a conduit (2) and means for cyclic distribution of a control fluid through a conduit (3) to a treatment accessory comprising a plurality of juxtaposed inflatable cells, such as a massaging boot (1), the inflating conduit (2) being connected to each cell in the treatment accessory through distributors (4) receiving the control fluid, each distributor comprises a movable obturating member such as a membrane arranged in such a manner as to permit the passage of the inflating fluid in a downstream direction when the local inflating pressure reaches a value which is a function of the pressure of the control fluid, the cells of the accessory being inflated in series, one after another, and then deflated, in a cyclic manner.

10 Claims, 3 Drawing Sheets

APPARATUS FOR MASSAGING THE BODY BY CYCLIC PRESSURE, AND CONSTITUENT MEANS

This invention relates to an apparatus for massaging parts of the body, by sequential cyclic pressure enabling assurance of a draining along the one or more parts treated. The invention also relates to a distributor intended for use with the apparatus.

BACKGROUND AND OBJECTS OF THE INVENTION

Many types of massage apparatus are known which comprise a treatment accessory (thigh boots, abdominal belts, etc.) adapted to be arranged in contact with a part of the body of a patient in order to achieve thereon a succession of local pressures progressing in the direction of lymphatic drainage to be effectuated. These accessories are generally comprised of a plurality of inflatable, juxtaposed cells which are successively inflated and then deflated according to a defined cycle. The following patents disclose such apparatus: French patents 2,511,241 and 2,405,708; U.S. Pat. No. 4,311,135 and 3,167,067; British patents 2,062,235, 483,111 and 2,077,108; and German patent 2,753,523. In these devices, the massaging accessory encircles the body member to be treated and the inflatable cells are connected by a network of conduits to an air distribution apparatus comprising in particular a rotating air distributor, or an air distributor having slide valves or a plurality of solenoid valves, such an installation being able to deliver successively the pneumatic pressure to each cell through the conduit with which it is connected. However, these systems are complex and cumbersome, and are only of little practical use, primarily because of the presence of the numerous pneumatic conduits necessary (one per inflatable cell), and the complexity of the distribution installation intended to assure the desired sequence of inflation.

Further, other bandage systems are known which are adapted to apply high, stable pressures to a body member in order to definitively expel the blood before a surgical procedure (U.S. Pat. No. 4,066,684; International application WO 85/01868). However, these devices are in general only able to function at relatively high pressures and are unable to operate at commonly used massaging pressures. Moreover, these devices do not work in a cyclic manner and are themselves relatively complex structures (in particular with respect to their distributors which comprise various related components such as: springs, pistons, piston rods, ball bearings, etc.) As a result, these systems do not provide a solution to the problem of cyclic massage or the simplification of known massaging devices.

The present invention proposes a considerable simplification of massaging devices of the type previously described and provides a massaging device having a reduced number of conduits and much simpler distribution means, while still being able to work in a cyclic fashion at low pressures required by the massaging action (on the order of 50 to 100 millibars).

Another object of the invention is to provide an apparatus enabling, in a very flexible manner, a control of the massage characteristics (value of the pressures, speed of drainage, amplitude of the pressure wave . . . ).

DESCRIPTION OF THE INVENTION

The apparatus according to the present invention, for executing a massage of a part of the body by cyclic pressures comprises in combination:

at least one treatment accessory formed of juxtaposed inflatable cells adapted to be arranged in contact with the body part to be massaged;

a source of compressed air connected to two pneumatic lines, an inflating line and a control line, the inflating line being provided with a pressure reducer for obtaining an inflation pressure Pg, while the control line is provided with a pressure reducer for obtaining a control pressure Pc such that $Pc < Pg$, a control unit adapted to control solenoid valves arranged in the inflating line and control line in such a manner as to cyclically control the opening and closing of the solenoid valves, an inflating conduit connected to the pneumatic inflating line and associated with the treatment accessory, and extending along and in proximity to the inflatable cells, a control conduit connected to the pneumatic control line and associated with the treatment accessory and extending along the inflating conduit and in proximity thereto, a plurality of distributors interposed in the inflating conduit at the level of the inflatable cells and connected to the control conduit for receiving the control fluid pressure (Pc), each distributor associated with a cell and comprising:

an upstream orifice connected to the upstream side of the inflating conduit, a downstream orifice connected to the downstream side of the inflating conduit, an inflating orifice connected to the inflatable cell and communicating with the upstream orifice, and an obturating membrane subject on one side to the local pressure of the inflating fluid and on the opposite side to the pressure of the control fluid, the membrane being adapted to open communication between the downstream orifice and the upstream orifice and the inflating orifice when the local pressure of the inflating fluid becomes greater than K times the pressure (Pc) of the control fluid (where K is a multiplier coefficient which is a function of the geometry of the distributor) for permitting a passage of inflating fluid downstream, and in the opposite case for isolating the downstream orifice with respect to the upstream and the inflating orifices.

Thus, regardless of the number of cells that are desired to be inflated successively, the apparatus comprises only one inflating conduit and one control conduit. The control conduit receives the control pressure Pc before the inflating fluid is distributed: the downstream orifices of the assembly of distributors are closed while the control pressure Pc which prevails at the level of these distributors is greater than the local inflating pressure (the relative inflating pressure is nil before distribution of the inflating fluid). When the inflating fluid is distributed at the pressure Pg, the first cell is inflated to the exclusion of the others which are isolated by the distributors; when, at this first cell, the local inflating pressure attains a pressure equal to K.Pc, the associated distributor of the first cell opens and the inflating fluid is distributed toward the second cell. From one to the next, the cells are thus inflated, assuring a drainage of the body from the zones in contact with the first cell to the zones in contact with the last cell. The control unit thus assures the closing of the solenoid valves and the deflation of the cells, the operation repeating in a cyclic manner.

As will be explained in greater detail below, the structure of such an apparatus (and in particular that of the distributors) is adapted to function at low pressures appropriate for achieving the massaging operation. It should be noted that the coefficient K which depends upon the geometry of the distributor will generally be chosen to be greater than 1 but may also be equal to or less than 1. The coefficient may also be different from one distributor to another.

Several treatment accessories may, in certain cases, be arranged in series in order to be inflated successively, for example a thigh boot and an abdominal belt. In the same manner, several accessories may be arranged in parallel in such a manner that their cells are inflated in a synchronized manner, for example two thigh belts intended to be applied around the two lower members. The invention may also be applied to any type of accessory: accessory with cells situated end to end, accessories with cells arranged in series, etc.

According to a preferred embodiment, each of the distributors, associated with each of the inflatable cells, comprises:

a first chamber which communicates with the upstream, downstream and inflating orifices, a second chamber provided with a passageway communicating with the control conduit, a membrane separating these chambers, and an opening adapted to support the membrane in such a manner that in this position, the membrane isolates the upstream orifice from the downstream and inflating orifices.

Such distributors have a very simple structure and are less burdensome and less cumbersome, and may be fastened without difficulty on the inflatable cells.

The invention also relates to such distributors capable of being used in any case where one desires to obtain an inflation in series from one series of elements. Such a distributor is characterized essentially in that it comprises a hollow body which is provided with three tubular branches and which defines a compartment, these branches and this compartment being arranged such that:

one of the branches, termed upstream, communicates with a secant second branch which is the inflating branch, situated opposite to the compartment, said upstream branch and inflating branch emptying into the compartment through an opening around the aforementioned opening, the compartment contains the aforementioned membrane, which divides it into a first chamber situated on the side of the opening and a second chamber opposite thereto, the membrane being adapted to be able to come into sealing contact with the opening, the compartment is closed by a sealing cover provided with means for connecting to a control fluid, permitting delivery thereof to the second chamber.

DESCRIPTION OF THE DRAWINGS

The invention having been described in a general manner heretofore, other characteristics, objects and advantages of the invention will become apparent from the description which follows in reference to the accompanying drawings, which present by way of non-limiting example one embodiment of the invention. In these drawings which form an integral part of the present description.

DESCRIPTION OF PREFERRED EMBODIMENTS

Figure 1:
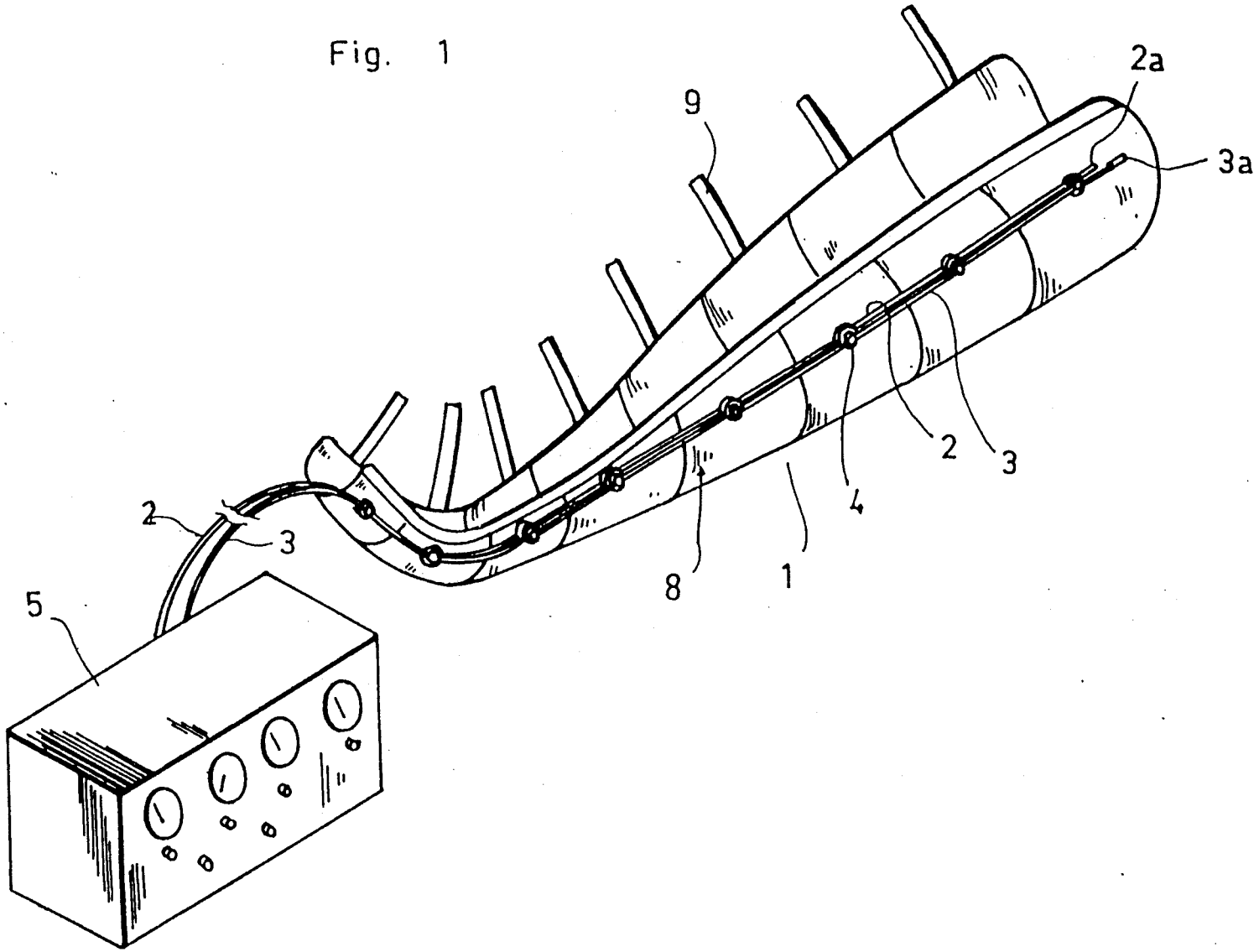
FIG. 1 is a schematic view of the assembly of a treatment apparatus according to the invention, intended to assure the massage of a lower member.

The massaging apparatus shown by way of example in the drawings comprises essentially a massaging accessory 1 adapted to be applied around a leg, an inflating conduit 2 and a control conduit 3 extending along and in proximity to the massaging accessory 1, a plurality of distributors such as shown at 4 interposed in these conduits and attached to the massaging accessory, and a compressed air sequential distribution unit 5.

The massaging accessory 1 is in particular of the type described in French patent 85.09764, comprising two flexible walls 6 and 7 which are joined between them to form several juxtaposed compartments in which are inserted inflatable pockets 8 made of an elastic material. The form of the assembly of the cells thus created is adapted to be closed around a body member to be treated and to follow the contours thereof, the straps 9, or belts or equivalent means (partially shown) being provided for maintaining the accessory around the member.

It should be understood, any other type of accessory may be provided in the apparatus of the invention (in particular a celled accessory arranged in series). In the same manner, the accessory may simply be formed by two walls sealingly welded together in appropriate places to form the cells.

The distributors 4 are, in the example, arranged in a line from one to the next in the vicinity of one longitudinal edge of the massage accessory 1.

Figure 3A:
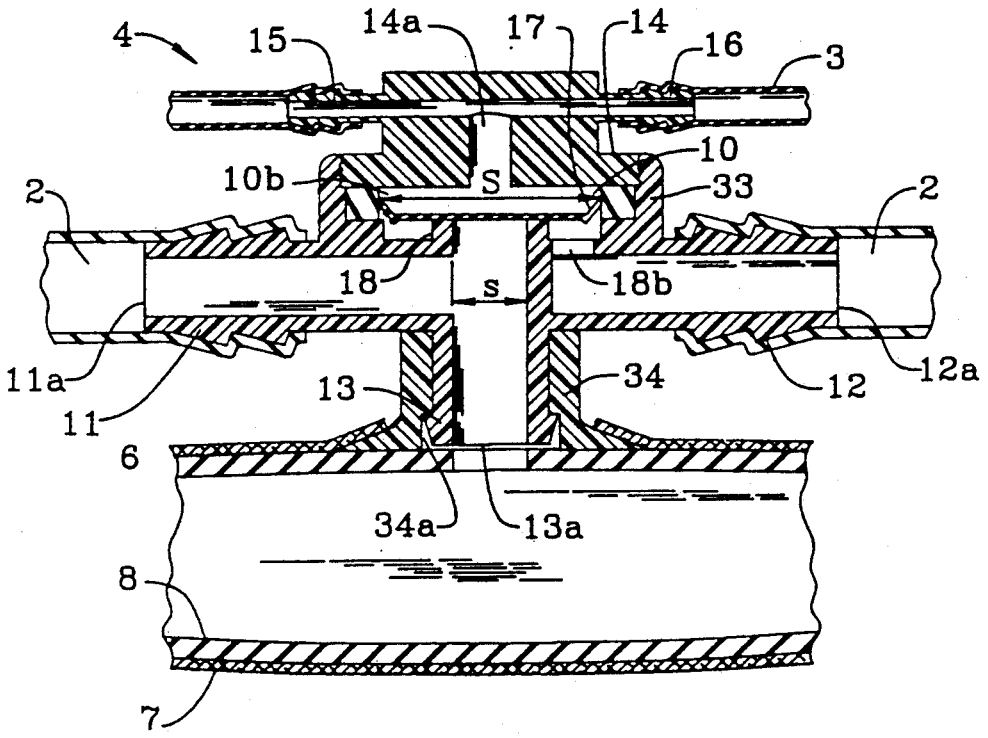
FIGS. 3*a* and 3*b* are cross sectional views of a distributor associated with an inflatable cell, respectively in closed position and in open position.
Figure 3B:
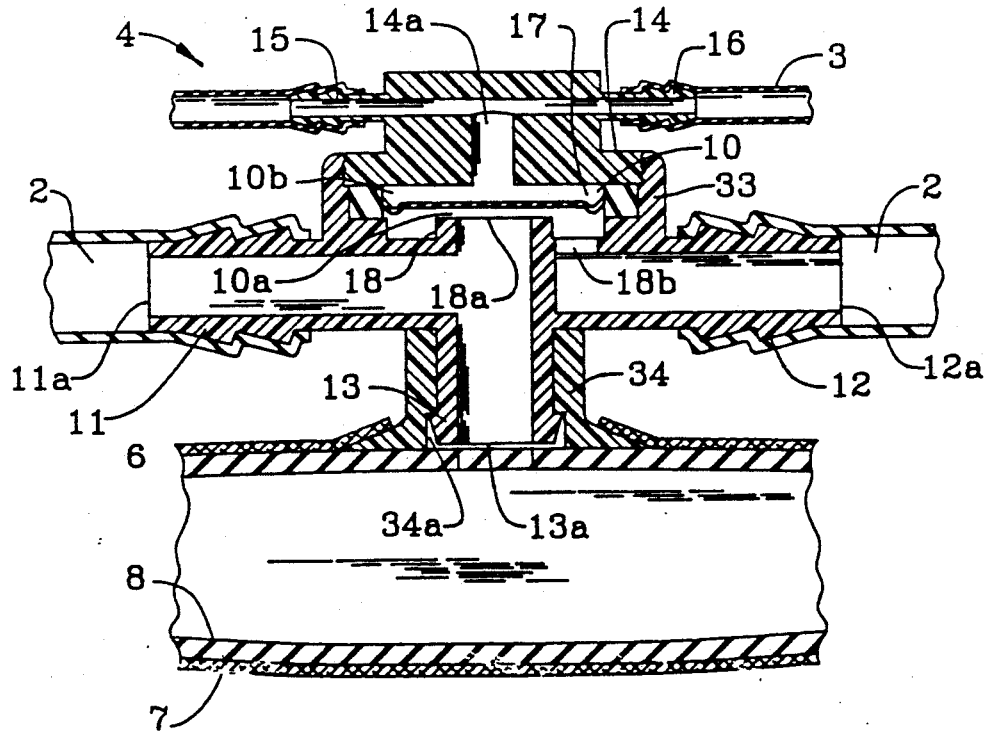

A distributor 4 is fixed to each cell 8 so as to permit inflating thereof. As shown in FIGS. 3*a* and 3*b*, these distributors may in particular be sealingly fixed on one face of the inflatable cell. In the example, this fixation is achieved by a reinforcing piece or nipple 34 which is fixed to the flexible wall of the cell by an adhesive. This nipple comprises a recess with an enlarged head 34*a* into which the nipple is snapped so as to seal an inflating ferrule 13 of the distributor.

Each distributor 4 of a generally T-shaped configuration comprises a hollow body 33 which defines a compartment 10 and comprises three tubular branches: an upstream branch 11, a downstream branch 12 in alignment with the upstream branch, and an inflating branch 13 orthogonal to the other two branches and situated opposite the compartment 10. These branches are molded in a one-piece form with the body 33 (in some cases they may be inserted and glued therein.)

A sealing cover 14 is mounted on the compartment 10 which in the example is screwed into the body 33 so as to close the compartment.

This cover 14 is provided with means for connecting a control conduit 3, formed by two male junction ferrules 15 and 16 situated essentially in alignment with each other. These ferrules are molded with the cover 14 (or if desired, are inserted and glued therein). The cover 14 is traversed by a passageway 14*a* so that the pressure Pc of the control fluid is established in the compartment 10.

The compartment 10 contains a flexible membrane 17 of an elastomer or other similar type material, of which the edges are sealingly crimped in the compartment 10 during screwing in of the cover. This membrane 17 separates the compartment 10 into two chambers 10*a* and 10*b*. The membrane is subjected on its upper face to the pressure Pc of the control fluid which exists in the chamber 10*b*, and on its lower face to the local pressure of the inflating fluid which exists in the chamber 10*a*. In some cases, this membrane may be subjected to external forces exerted either by a damping system, or by a system of springs, especially to avoid vibrations.

The tubular upstream branch 11 forms a male junction ferrule (defining the upstream orifice 11*a*) and communicates with the secant inflating branch 13 which itself forms a male junction ferrule (defining the inflating orifice 13*a*). These two branches 11 and 13 empty into the chamber 10*a* of the compartment 10 through an opening 18*a* surrounding a port 18 supporting the membrane.

The downstream branch 12 forms a male junction ferrule (defining the downstream orifice 12*a*) and is isolated from the first two orifices. It communicates with the chamber 10*a* through an opening 18*b* situated at the periphery of the port 18.

The inflating conduit 2 is connected to branches 11 and 12 (the inlet situated on the side of the distribution unit being connected to the upstream branch 11 and the outlet situated on the opposite side being connected to the downstream branch 12). The control conduit 3 is itself connected to the function ferrules 15 and 16.

When the membrane 17 is pressed against the port 18, it is subjected on one side to the local inflating pressure of a cross-section s (defined by the port 18), and on the other side to the control pressure Pc on a cross-section S (corresponding to the diameter of the membrane). The ratio S/s is designated by the multiplier coefficient K.

When the control pressure Pc is established in the chamber 10*b*, the distributor remains in a closed state while the local inflating pressure existing in the branches 11 and 13 remains less than K.Pc (FIG. 3*a*). In this position, the membrane 17 is in contact with the port 18 and the upstream branch 12 is isolated from the downstream branch 11 and the inflating branch 13. The inflating fluid is not transmitted toward the downstream cells.

When the inflating pressure in the cell under consideration attains and surpasses K.Pc, the membrane 17 moves away from the port and opens communication toward the downstream branch 12 (FIG. 3*b*). The inflating fluid is delivered toward the next cell. The inflation is thus carried out from one cell to the next, i.e. from the first cell of the accessory to the last.

Figure 2:
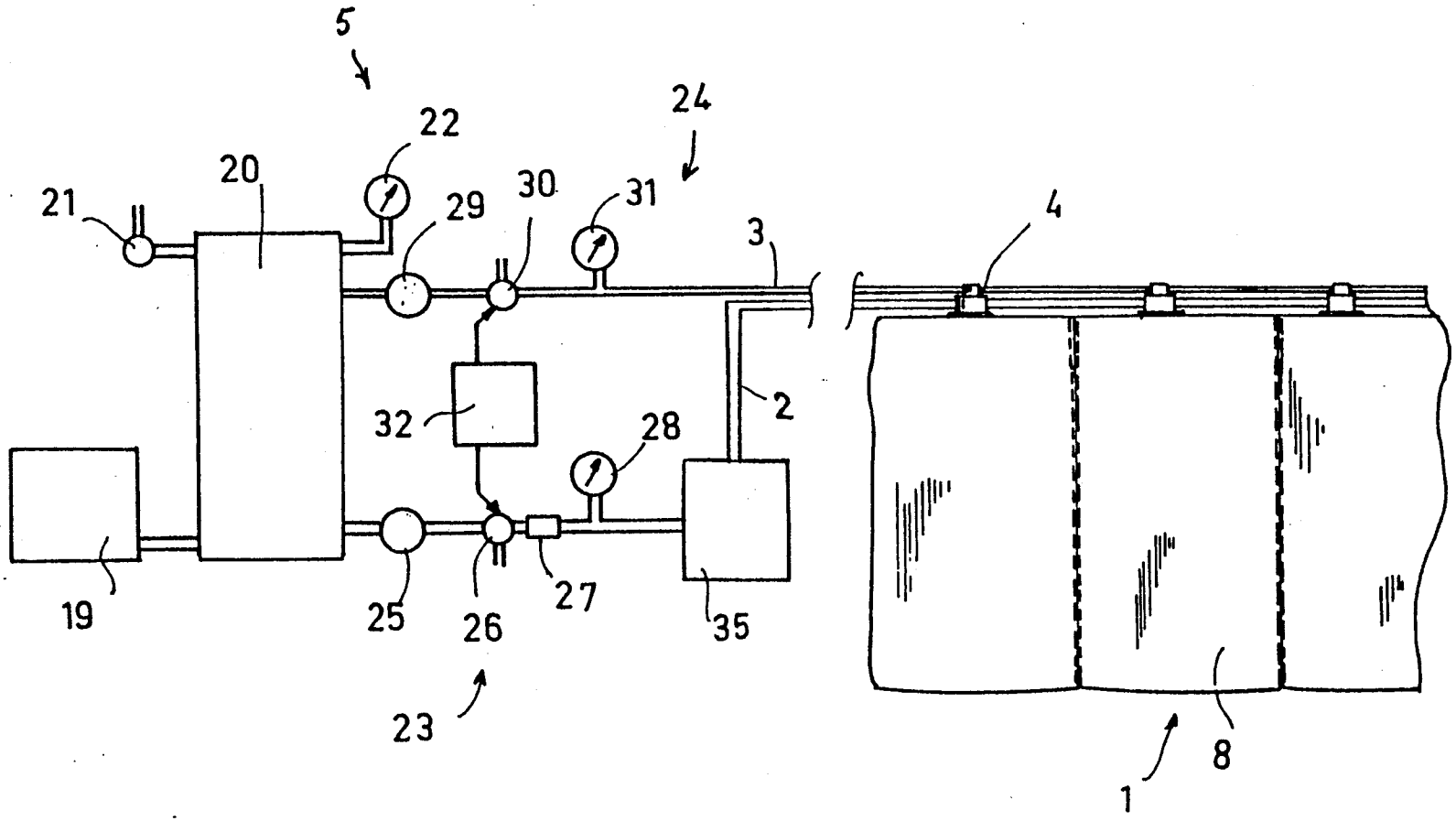
FIG. 2 is a partial schematic view of the system.

The inflating conduits 2 and the control conduit 3 are connected to a unit 5 comprising means for the distribution of the inflating fluid and means for distribution of the control fluid. In the example shown in FIG. 2, a compressor 19 feeds high pressure compressed air to a reservoir 20 provided with a safety valve 21 and a pressure regulator 22. The reservoir 20 is connected to a pneumatic inflating line 23 and to a pneumatic control line 24.

The inflating line 23 to which is connected the inflating conduit 2 comprises essentially an adjustable pressure reduction valve 25 for reducing the pressure to an inflating pressure Pg, and solenoid valve 26, for example of a threeway type to permit the release of air to the outside, a flow limiter 27 and a pressure gauge 28. Moreover, a buffer reservoir 35 may be provided in this inflating line in order to dampen the inflation of the first cells, particularly when they have a lesser volume, as is the case for a leg boot extending down to the foot. This reservoir 35 may introduce a delay time to the inflation produced further along.

In the example, the inflating conduit 2 is open at its extremity 2*a* situated downstream from the last inflatable cell such that the deflation is carried out at the end of the sequence by this extremity and by the solenoid valve 26. The deflation may be obtained in a different manner, in particular by a special solenoid valve.

The control line 24 to which the control conduit 3 is connected comprises essentially an adjustable pressure reducing valve 29 reducing the pressure to a control pressure $Pc < Pg$, a three-way solenoid valve 30 to permit release of air from the control conduit 3, and a control pressure gauge 31.

The control conduit 3 is closed at its end 3*a* situated downstream from the last inflatable cell such that placing it under pressure assures a stable establishment of the control pressure Pc.

The solenoid valves 26 and 30 are electrically operated from an electronic control unit 32 adapted to direct cyclically the opening and the closing thereof (that is, pressurizing the conduits 2 and 3 and opening them to the free air). The unit 32 is adapted to impose a delay time for the opening of solenoid valve 26 so that the control pressure Pc is established first in the control conduit 3 and the chambers 10*b* of the distributors.

The duration of the opening/closing cycles and the cyclic ratio are controlled as a function of the nature of the massage to be achieved. The control of the output pressure from the regulator 25 (inflation pressure Pg) permits adjusting the characteristics of the compression wave which assures the lymphatic draining (the speed of drainage, that is the speed of displacement of the pressure front from one cell to the next, as well as the amplitude of this pressure front, are functions of the difference Pg - K.Pc).

At the end of each sequence of compression, the control conduit 3 is depressurized and the cells deflate by the open extremity of the conduit 2*a* and by the solenoid valve 26.

If the duration of the inflating sequence exceeds the time necessary to inflate all of the cells, the air will escape through the last distributor which receives it, as if through a safety valve, the pressure never being able to exceed the control pressure. If the duration of the inflation sequence is less than the duration necessary for the inflation to be achieved in the latter cells, they will not be inflated. It is thus possible to inflate only a portion of the massage accessory, the number of uninflated cells being able to be controlled by an adjustment of the duration of the sequence of inflation.

Further, the ports 18 of the different distributors 4 may have different diameters. By controlling the cross section -s- of the different distributors, one may vary the multiplier coefficient K from one distributor to another. The cells may thus be subjected to different inflation pressures (K.Pc), as high as the coefficient K of the cell under consideration will be raised. The invention permits carrying out massages at different pressures adapted to different zones of the body to which the cells are applied.

As will be understood, the order of inflation of the cells is a function of the order in which they are connected to the inflation conduit 2. This order may be an order of geometric succession, but it may also be different.

I claim:

1. An apparatus for massaging parts of the body by cyclic pressure, comprising in combination:

at least one treatment accessory (1) comprising inflatable juxtaposed cells (8) arranged to be disposed in contact with the part of the body to be massaged, a source of compressed air (19, 20) connected to two pneumatic lines comprising an inflating line (23) and a control line (24), said inflating line having a first pressure reducer (25) for providing an inflating pressure Pg and said control line having a second pressure reducer (29) for providing a control pressure Pc such that $Pc < Pg$, a control unit (32) for operating solenoid valves (26, 30) arranged in said inflating line (23) and said control line (24) in such a manner as to cyclically control the opening and the closing of said solenoid valves, an inflating conduit (2) connected to said pneumatic inflating line (23) and associated with said treatment accessory (1) and extending along and in proximity to said inflatable cells (8), a control conduit (3) connected to said pneumatic control line (24) and associated with said treatment accessory (1) and extending along said accessory and said inflating conduit and in proximity thereto, a plurality of distributors (4) interposed in said inflating conduit (2) adjacent said inflatable cells (8) and connected to said control conduit for receiving the control pressure (Pc), each distributor being associated with one cell and comprising:

an upstream orifice (11*a*) connected on its upstream side to the inflating conduit (2), a downstream orifice (12*a*) connected on its downstream side to said inflating orifice, an inflating orifice (13*a*) connected to said inflatable cell and communicating with the upstream orifice (11*a*), and a closure membrane (17) subject on one side thereof to the local pressure of the inflating fluid and on the other side to the pressure of the control fluid, said membrane being arranged to open communication between said downstream orifice (12*a*) and said upstream and inflating orifices (11*a*, 13*a*) when the local pressure of the inflating fluid becomes greater than K times the pressure of the control fluid (Pc), wherein K is a multiplier coefficient which is a function of the geometry of said distributor, in order to permit the downstream passage of inflating fluid or to isolate the downstream orifice (12*a*) with respect to the upstream orifice and the inflating orifice.

2. A massage apparatus as in claim 1 and wherein said pressure reducers (25, 29) in said inflating line and said control line are adjustable.

3. A massage apparatus as in claim 2 and wherein said control unit (32) comprises an electronic control unit for cyclically opening and closing said solenoid valves (26, 30) with a delay time for the solenoid valve (26) in said inflating line with respect to the control line.

4. A massage apparatus as in claim 3 and wherein said inflating conduit (2) opens to ambient air downstream thereof at the last of said inflatable cells.

5. A massage apparatus as in claim 4 and wherein said solenoid valves (26, 30) in said inflating line and said control line are three-way valves for opening to free air for deflating said cells.

6. A massage apparatus as in claim 5 and wherein each of said distributors (4) comprises:

a first chamber (10*a*) in communication with said upstream, downstream and inflating orifices (11*a*, 12*a*, 13*a*), a second chamber (10*b*) having a passageway (14*a*) in communication with said control conduit (3), said membrane (17) separating said chambers, and a port (18) arranged so as to support said membrane for isolating said downstream orifice (12*a*) from said upstream and inflating orifices (11*a*, 13*a*).

7. A massage apparatus as in claim 6 and wherein each of said distributors (4) comprises three tubular branches (11, 12, 13) and a compartment (10) containing said membrane (17), said branches and said compartment being arranged such that:

one of said branches (11) defining said upstream orifice (11*a*) communicating with a secant branch (13) defining said inflating orifice (13*a*), said one of said branches (11) and said secant branch (13) emptying into said compartment (10) through an opening (18*b*) situated at the periphery of said port (18), and said compartment (10) being closed by a sealing cover (14) provided with means for connecting the inlet and outlet of said control conduit (3), said cover being transversed by a passageway for admitting said control fluid pressure Pc into said second chamber (10*b*) of said compartment.

8. A massage apparatus as in claim 6 and wherein said treatment accessory (1) comprises two flexible walls (6, 7) interconnected so as to form compartments, and inflatable pouches (8) in said compartments forming said inflatable cells.

9. A fluid distributor comprising a hollow body (33) having upstream, inflating and downstream tubular branches (11, 12, 13) and defining a compartment (10) having a port (18) and arranged such that:

said upstream being in communication with said inflating branch (13) situated opposite to said compartment (10), said upstream branch and said inflating branch emptying into said compartment (1) through an opening (18*a*) forming said port (18), said downstream branch (12) being isolated from said upstream and said inflating branches (11, 13) and in communication with said compartment (10) through an opening (18*b*) at the periphery of said port (18), said compartment (10) containing a membrane (17) dividing said compartment into a first chamber (10*a*) containing said port (18) and a second chamber (10*b*) opposite thereto, said membrane being arranged to come into sealing contact with said port (18), and a sealing cover (14) for closing said compartment (10) and having means for connecting a control fluid line for delivering control fluid from said line to said second chamber (10*b*).

10. A distributor as in claim 9 and wherein said tubular branches (11, 12, 13) are arranged to form junction ferrules, said upstream (11) and downstream (12) branches being essentially in linear alignment with each other, and said control fluid line connecting means comprising two junction ferrules (15, 16) in essentially linear alignment with each other.

* * * * *